United States Patent [19]

Ibaraki et al.

[11] 4,098,623

[45] Jul. 4, 1978

[54] METHOD FOR HEAT TREATMENT OF TITANIUM ALLOY

[75] Inventors: Yoshiro Ibaraki; Akihiko Yamamoto, both of Niihari; Toshimi Sasaki, Abiko, all of Japan

[73] Assignee: Hitachi, Ltd., Japan

[21] Appl. No.: 709,119

[22] Filed: Jul. 27, 1976

[30] Foreign Application Priority Data

Aug. 1, 1975 [JP] Japan ..... 50-93100
Aug. 13, 1975 [JP] Japan ..... 50-97660

[51] Int. Cl.[2] ..... C21D 1/00
[52] U.S. Cl. ..... 148/133; 148/11.5 F; 75/175.5
[58] Field of Search ..... 148/133, 20.3, 11.5 R, 148/11.5 F, 32.5; 75/175.5

[56] References Cited

U.S. PATENT DOCUMENTS

| | | | |
|---|---|---|---|
| 3,151,003 | 9/1964 | Vordahl | 148/133 |
| 3,169,085 | 2/1965 | Newman | 148/11.5 F |
| 3,489,617 | 1/1970 | Woverfel | 148/11.5 F |
| 3,748,194 | 7/1973 | Ruckle et al. | 148/133 |
| 3,867,209 | 2/1975 | Horiuchi | 75/175.5 |

OTHER PUBLICATIONS

McClintier, R. et al., Physical Metalurgy and Heat--Treatment of Titanium Alloys; Ohio, 1955, pp. 3-21.

*Primary Examiner*—Walter R. Satterfield
*Attorney, Agent, or Firm*—Craig & Antonelli

[57] ABSTRACT

Titanium alloy or cast titanium alloy is heat-treated in vacuum or a neutral atmosphere to convert the abnormal structure of the alloy to normal $\alpha$ or $\alpha + \beta$ structure. The titanium alloy or cast titanium alloy thus heat-treated can have sufficiently good material characteristics by the ordinary successive heat treatments.

10 Claims, 5 Drawing Figures

X400X2

X400X2

X400X2

X400X2

METHOD FOR HEAT TREATMENT OF TITANIUM ALLOY

BACKGROUND OF THE INVENTION

This invention relates to a method for heat treatment of titanium alloy or cast titanium alloy.

It is difficult to heat-treat titanium alloy because of both its high activity at an elevated temperature and the presence of a two-phase alloy. An abnormal structure develops if a temperature of solid solution treatment, which must be carried out at an elevated temperature, or a forging temperature is too high, or if the alloy is overheated by the heat generated at processing of the alloy. Once the abnormal structure has developed, it is difficult to effect its structural improvement even if it is subjected to successive heat treatment. The presence of the abnormal structure lowers the material characteristics of the alloy.

Heretofore, the titanium alloy having the abnormal structure has not been practically usable due to its lowered material characteristics unless it has been subjected to further processings such as forging, etc., resulting in a large increase in material cost, processing cost, etc. For example, when commercially available Ti-6A1-4V alloy is heated at a temperature over about 980° C, an abnormal structure develops, as shown in FIG. 1*a*. The abnormal structure is an $\alpha'$ single phase, which can be converted to the normal, $\alpha$ or $\alpha + \beta$ structure only when heat and processing are applied thereto, for example, by forging, etc. The $\alpha'$ single phase is liable to develop together with Widmanstatten structure due to a mishandling of the solid solution treatment or if heat buildup occurs during forging. These structures are not improved even by solid solution heat treatment and aging heat treatment, i.e. the ordinary treatments to increase the strength. That is, the ordinary heat treatments are ineffective in this situation, and thus good material characteristics of the titanium alloy cannot be completely obtained.

In the case of cast titanium alloy, it is cooled from a high temperature, and in the most cases the cooling rate is not constant. Due to this fluctuation in cooling rate, a mixed structure containing abnormal acicular $\alpha$ phases as a predominant structure is obtained. It is hard to carry out the solid solution heat treatment and heat aging treatment of the mixed cast structure to obtain an increased strength. The alloy in the mixed cast structure as such has a small elongation. Due to the small elongation, to date, the cast titanium alloy has been used, in the most cases, after only such a treatment as annealing has been applied thereto. That is, the cast titanium alloy has been used without fully improving its material characteristics. It is very difficult to carry out heat treatment of the structure of cast titanium alloy to obtain better material characteristics, and the structure of the cast Ti-6A1-4V alloy as such according to the ordinary method is shown in FIG. 2*a*. This structure contains abnormal acicular $\alpha$ phases as a predominant one, and unless heat and processing are applied thereto, for example, by forging, etc., a good effect cannot be obtained through application of the solid solution treatment and aging treatment, the ordinary heat treatment to obtain better material characteristics. Thus, to obtain material characteristics almost equivalent to those of forged or rolled materials, an improvement of structure is required for the cast Ti-6A1-4V alloy.

SUMMARY OF THE INVENTION

An object of the present invention is to provide a method for improving a structure of a titanium alloy having an abnormal, $\alpha'$, structure solely by heat treatment without any processing such as forging, etc., to obtain material characteristics almost equivalent to those of the forged or rolled titanium alloy heat treated according to the ordinary method.

Another object of the present invention is to provide a method for improving a structure of cast titanium alloy having an abnormal acicular $\alpha$ phase structure, solely by heat treatment without any processing such as forging, etc. to obtain material characteristics almost equivalent to those of the forged or rolled material heat treated according to the ordinary method.

According to one embodiment of the present invention, a titanium alloy containing an abnormal $\alpha'$ structure FIG. 1*a* is subjected to from 2 to 10 successive cycles of heating and cooling from a lower temperature ranging between room temperature and 600° C to a higher temperature ranging between 850° C and 1000° C in vacuum or a neutral atmosphere, and then to cooling to room temperature by cooling in a furnace or cooling the alloy spontaneously to improve the abnormal structure.

According to another embodiment of the present invention, cast titanium alloy is subjected to from 2 to 10 successive cycles of heating and cooling from a lower temperature ranging between room temperature and 600° C, to a higher temperature ranging between 850° C and 1000° C in vacuum or a neutral atmosphere, and then to cooling to room temperature by cooling in a furnace or cooling the alloy spontaneously to improve the cast structure.

DESCRIPTION OF EMBODIMENTS OF THE INVENTION

Titanium alloy undergoes reaction with oxygen, hydrogen, etc. when it is brought in contact with oxygen, hydrogen, etc. at an elevated temperature, and is therefore necessary that the titanium alloy instead, be treated in vacuum, or a neutral atmosphere of helium, argon, etc. The upper temperature limit of the lower temperature range for the successive cyclic heating and cooling can be raised to 600° C, depending upon the qualities of the titanium alloy or the cast titanium alloy. The upper temperature limit of the higher temperature range can be raised up to such a temperature so as not to cause this temperature grain growth, also depending upon the quality of the alloy, and one's desire to accelerate the diffusion of the alloying elements, etc., and to shorten the heat treating time. In the case of titanium alloy, the higher temperature ranges between 850° C and 1000° C. The number of cycles of heating and cooling is determined in connection with temperature. The higher the temperature of the higher temperature range, the less the number of cycles, whereas the lower the temperature of higher temperature range, the more the number of cycles necessary to effect the desired results. However, no significantly better effect can be obtained, if more than 10 successive cycles of heating and cooling are made.

EXAMPLE 1

Figure 1A:
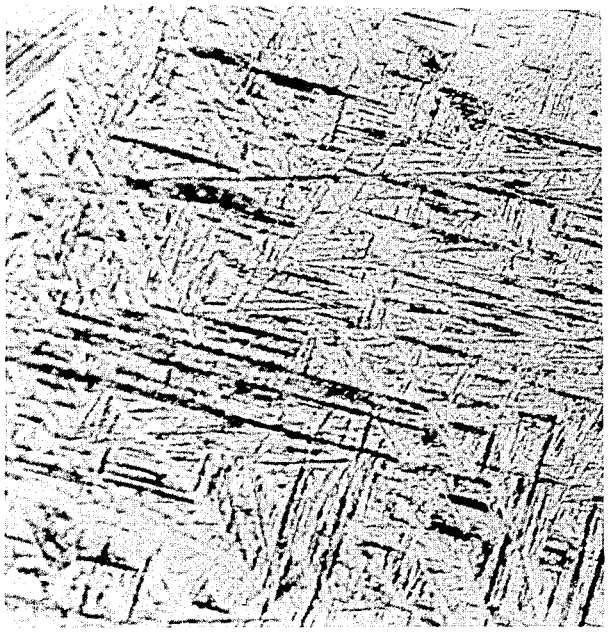
FIG. 1*a* is a picture showing an abnormal, $\alpha'$, structure of commercially available Ti-6Al-4V alloy before the application of the present invention thereto.
Figure 1B:
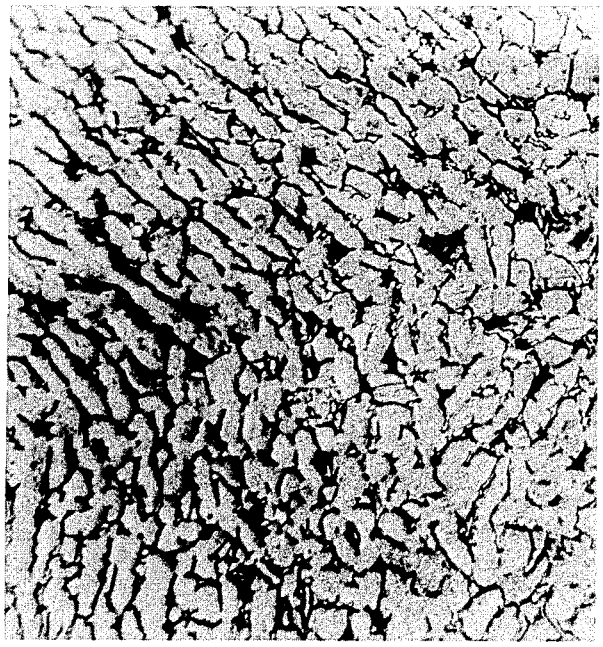
FIG. 1*b* is a picture showing the structure TI-6A1-4V alloy converted to the normal structure according to the present invention.

A test piece made from commercially available Ti-6Al-4V alloy having an abnormal structure shown in FIG. 1*a* is subjected to the following 3 cycles of heating and cooling room temperature → 930° C → 500° C → 930° C → 500° C → 930° C → furnance cooling → room temperature in an argon atmosphere, whereby a structure shown in FIG. 1*b* is obtained. The resulting structure is a normal $\alpha$ structure containing a small amount of $\beta$ structure and can posses good property characteristics by successive ordinary treatments.

EXAMPLE 2

Figure 2A:
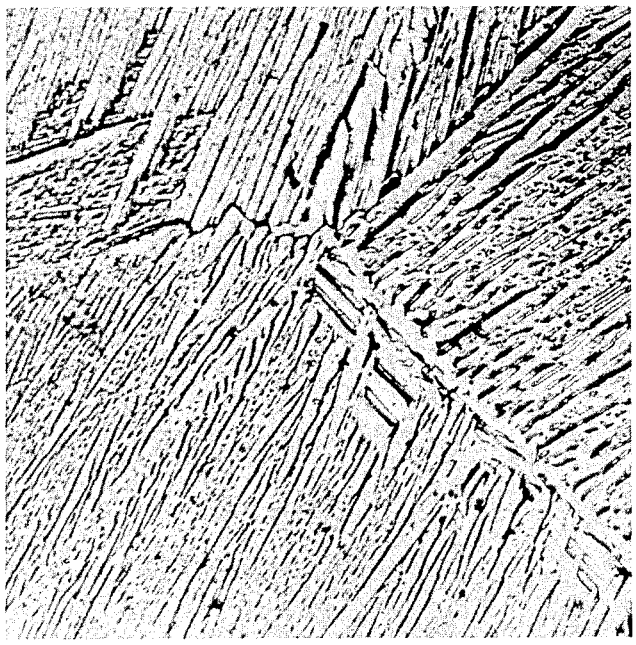
FIG. 2*a* is a picture of the abnormal structure of cast Ti-6Al-4V alloy obtained by remelting commercially available Ti-6Al-4V alloy before the application of the present invention thereto.
Figure 2B:
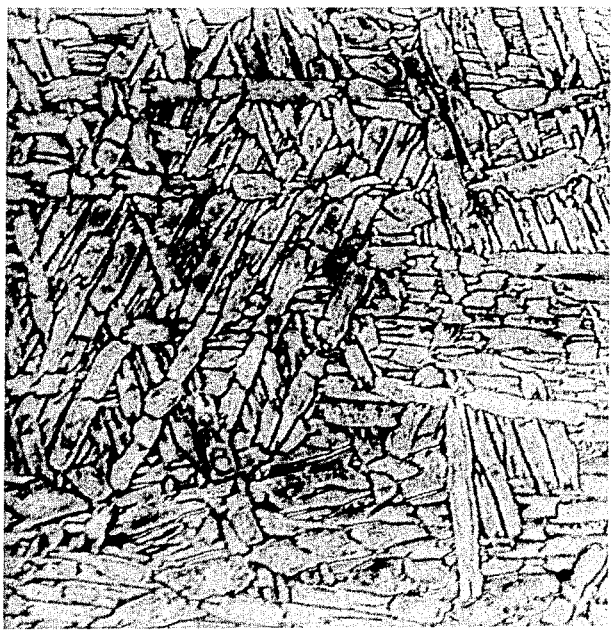
FIG. 2*b* is a picture of the structure of cast Ti-6Al-4V alloy improved according to the present invention.
Figure 3:
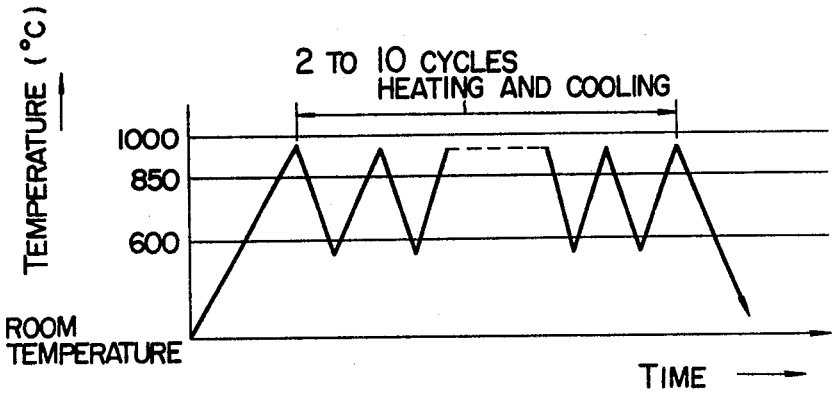
FIG. 3 is a diagram showing the condition of cyclic heating and cooling.

A test piece having a cast structure made from cast Ti-6A1-4V alloy obtained by remelting commercially available Ti-6A1-4V alloy shown in FIG. 2*a* is subjected to the following 3 cycles of heating and cooling: room temperature → 930° C → 500° C → 930° C → 500° C → 930° C → (furnace cooling) → room temperature in an argon atmosphere, whereby a structure shown in FIG. 2*b* is obtained. The resulting structure is a normal $\alpha$ structure containing a small amount of $\beta$ structure, and can possess good material characteristics by successive ordinary heat treatments.

According to the present invention, titanium alloy having an abnormal structure can be improved to normal $\alpha$ or $\alpha + \beta$ structure, and thus a titanium alloy having good material characteristics can be obtained only by ordinary heat treatment, that is, solid solution heat treatment and aging treatment.

In the case of cast titanium alloy, material characteristics almost equivalent to those of forged or rolled material can be obtained solely by similar heat treatment, and thus good material characteristics properly possessed by the titanium alloy can be obtained.

What is claimed is:

1. A method of heat treating a wrought titanium alloy having an abnormal structure that is an $\alpha'$ single phase of the type depicted in FIG. 1*a*, which comprises:

(1) subjecting the wrought titanium alloy, in a neutral atmosphere to from 2 to 10 cycles of heating and cooling, each cycle after the first cycle being in immediate succession to the preceding cycle, the titanium alloy being heated to a temperature ranging from 850° C to 1000° C and being cooled to a temperature ranging from room temperature to 600° C in each cycle, and then;

(2) when, at the end of all successive cycles, the temperature of the alloy is above room temperature, cooling the alloy to room temperature, the cycles being selected to yield a normal structure that is an $\alpha$ structure or $\alpha + \beta$ structure of the type depicted in FIG. 1*b* having improved material characteristics.

2. A method according to claim 1, wherein the neutral atmosphere is an atmosphere selected from the group consisting of vacuum, helium and argon.

3. A method according to claim 1, wherein wrought titanium alloy is a Ti-6A1-4V alloy and the alloy is heated to about 930° C and then cooled to about 500° C during each cycle.

4. A method according to claim 3, wherein the neutral atmosphere is an argon atmosphere.

5. A method according to claim 4, wherein the wrought titanium alloy is subjected to three cycles of heating and cooling in which the titanium alloy at room temperature is initially heated to a temperature of 930° C., then cooled to a temperature of 500° C., followed by heating to a temperature of 930° C. and cooling to a temperature of 500° C. and again heating to 930° C. and cooling to room temperature to provide a normal $\alpha$ structure containing a small amount of $\beta$ structure.

6. A method of heat treating a cast titanium alloy having an abnormal structure that is an acicular $\alpha$ phase of the type depicted in FIG. 2*a*, which comprises:

(1) subjecting the cast titanium alloy, in a neutral atmosphere, to from 2 to 10 cycles of heating and cooling, each cycle after the first cycle being in immediate succession to the preceding cycle, the cast titanium alloy being heated to a temperature ranging from 850° C to 1000° C and being cooled to a temperature ranging from room temperature to 600° C in each cycle, and then;

(2) when, at the end of all successive cycles, the temperature of the cast titanium alloy is above room temperature, cooling the cast titanium alloy to room temperature, the cycles being selected to yield a normal structure that is an $\alpha$ structure or an $\alpha + \beta$ structure of the type depicted in FIG. 2*b* having improved material characteristics.

7. A method according to claim 6, wherein the neutral atmosphere is an atmosphere selected from the group consisting of vacuum, helium and argon.

8. A method according to claim 6, wherein the cast titanium alloy is a Ti-6A1-4V alloy and the cast alloy is heated to about 930° C and then cooled to about 500° C during each cycle.

9. A method according to claim 8, wherein the neutral atmosphere is an argon atmosphere.

10. A method according to claim 9, wherein the cast titanium alloy is subjected to three cycles of heating and cooling in which the alloy at room temperature is heated initially to a temperature of 930° C. and then cooled to 500° C., followed by heating to 930° C. and cooling to 500° C. and again heating to 930° C. and cooling to room temperature to provide a normal $\alpha$ structure containing a small amount of $\beta$ structure.

* * * * *